United States Patent [19]

Edgar

[11] 4,131,120

[45] Dec. 26, 1978

[54] ASH TRAY

[76] Inventor: Ralph W. Edgar, 928 N. Vine, Orrville, Ohio 44667

[21] Appl. No.: 852,828

[22] Filed: Nov. 18, 1977

[51] Int. Cl.[2] ..... A24F 13/18; A24F 19/10

[52] U.S. Cl. ..... 131/235 R; 131/238; 131/240 R

[58] Field of Search ..... 131/238, 231, 235, 239, 131/240 R, 241; 211/60 M; 206/242, 244, 246

[56] References Cited

U.S. PATENT DOCUMENTS

| | | | |
|---|---|---|---|
| 1,404,755 | 1/1922 | Gay | 131/231 |
| 2,845,076 | 7/1958 | Ostergard | 131/246 |
| 2,883,992 | 4/1959 | Hastings | 131/240 R X |
| 3,503,520 | 3/1970 | Meyer | 131/239 X |

*Primary Examiner*—Stephen C. Pellegrino
*Attorney, Agent, or Firm*—Robert D. Farkas

[57] ABSTRACT

An ash tray utilizes an open mouth container having one wall thereof extended beyond the boundaries defined by adjacent walls thereto forming a wall for an adjacent container having an opposed wall thereof provided with a plurality of notches located in the marginal edges adjacent the open mouth portion of the opposed wall and a plurality of holes passing through the opposed wall. The base of the adjacent container is provided with a plurality of holes. Tabs extend outwardly from the opposed wall, serving as handles for the apparatus when mounted in sliding fashion to a vertical drawer receiving opening in a motor vehicle.

11 Claims, 4 Drawing Figures

ASH TRAY

BACKGROUND OF THE INVENTION

1. THE FIELD OF THE INVENTION

The present invention relates to ash trays and more particularly to that class of ash receivers adapted to be slideably affixed to an opening in a vertical surface.

2. DESCRIPTION OF THE PRIOR ART

The prior art abounds with ash receivers. Typical of such ash receivers are the type commonly found in motor vehicles having guide rails thereon for purposes of supporting the receiver on a track disposed inwardly from a dashboard panel, located adjacent to an opening therein through which the ash tray passes. When the ash tray is not in use, the outermost side wall thereof resides in or adjacent to the wall-like surface of the dashboard. Handles, or other protrusions or indentations provide surfaces which may be utilized in withdrawing the ash tray from its storage position behind the dashboard. Cigarette snuffing surfaces, comprising a substantially horizontal surface, usually having a small hole therein, are commonly found within the interior of the ash tray, being secured generally to an interior front surface of the tray. Many such devices are equipped with release means, facilitating the removal of the ash tray from engagement with the dashboard and the supporting rails, if any, so as to permit the user to empty the tray when an accumulation of ash-like wastes have been stored within the ash receiving compartment of the apparatus.

Such devices include electrically operated cigarette lighters removably installed in cigarette lighter receptacles, sometimes disposed in a substantially horizontal surface, located adjacent the open mouth portion of the ash tray.

Conventional ash trays, of the automotive type described, fail to provide supporting structure for holding pipes, cigars and cigarettes when such devices are not being used.

SUMMARY OF THE INVENTION

A primary object of the present invention is to provide an ash tray having storage facilities for smoking implements thereon.

Another object of the present invention is to provide an ash receiver which may be slideably affixed to a panel of the motor vehicle.

Still another object of the present invention is to provide an ash receiver having smoking implement storage facilities constantly in view of the user thereof.

Yet another object of the present invention is to provide a smoking implement holder which is permanently affixed to an ash receiver of a motor vehicle.

A further object of the present invention is to provide an ash receiver, having smoking article storage facilities, which may be installed into existing motor vehicle ash receiver holding fixtures.

Another object of the present invention is to provide an ash receiving and smoking implement retaining device which serves to coordinate a smoker's needs in one central location.

Still another object of the present invention is to provide an ash receiver which may support cigarettes, cigars and pipes, as well as receive the waste, in ash form, generated thereby.

Heretofore, motor vehicle smokers, were forced to store smoking implements, such as pipes, cigars and the like, in either their pockets, the glove compartment of the vehicle, or on other hopefully stable horizontal surfaces of the vehicle. Once such smoking device, such as a large cigar or pipe apparatus, was ignited, a vehicle operator found it extremely difficult to place such lighted smoking implement in a secure resting position. Often times, while operating the motor vehicle, the user was forced to maintain such lighted implement in his hands or teeth for a sufficient period of time that such implement either burned out or became extinguished in the natural course. Pipe smoking, in particular, was extremely difficult and dangerous. Conventional automotive and motor vehicle ash receivers are small and when full, fail to provide an adequate space to receive large lighted smoking objects. When these smoking utensils, as well as packs of cigarettes, are not being used, the user was forced to store same in diverse locations, remote from the location in which his other smoking needs are satisfied, to wit, the ash tray. When on long drives, a pipe smoker prefers to utilize two or more pipes, so as to allow each pipe to cool down before refilling it again with tobacco. Loose matches are often located in inaccessible places, or worse, are found in a wide variety of undesired locations.

The present invention recognizes these problems and in a simple and unique fashion provides a user with a central location for the storage of lit and unlit smoking apparatus, attached to an ash receiver, all being capable of being mounted on a dashboard, rear of a front seat, or if desired, on the door panels of a motor vehicle. Pipes, cigars, cigarettes, matches, lighters and the like may all be disposed on or in retaining surfaces in a neat and orderly fashion. Smoking articles that have been ignited may be stored with equal facility, despite their size and shape.

These objects as well as other objects of the present invention will become more readily apparent after reading the following description of the accompanying drawings.

DESCRIPTION OF THE PREFERRED EMBODIMENT

Figure 1:
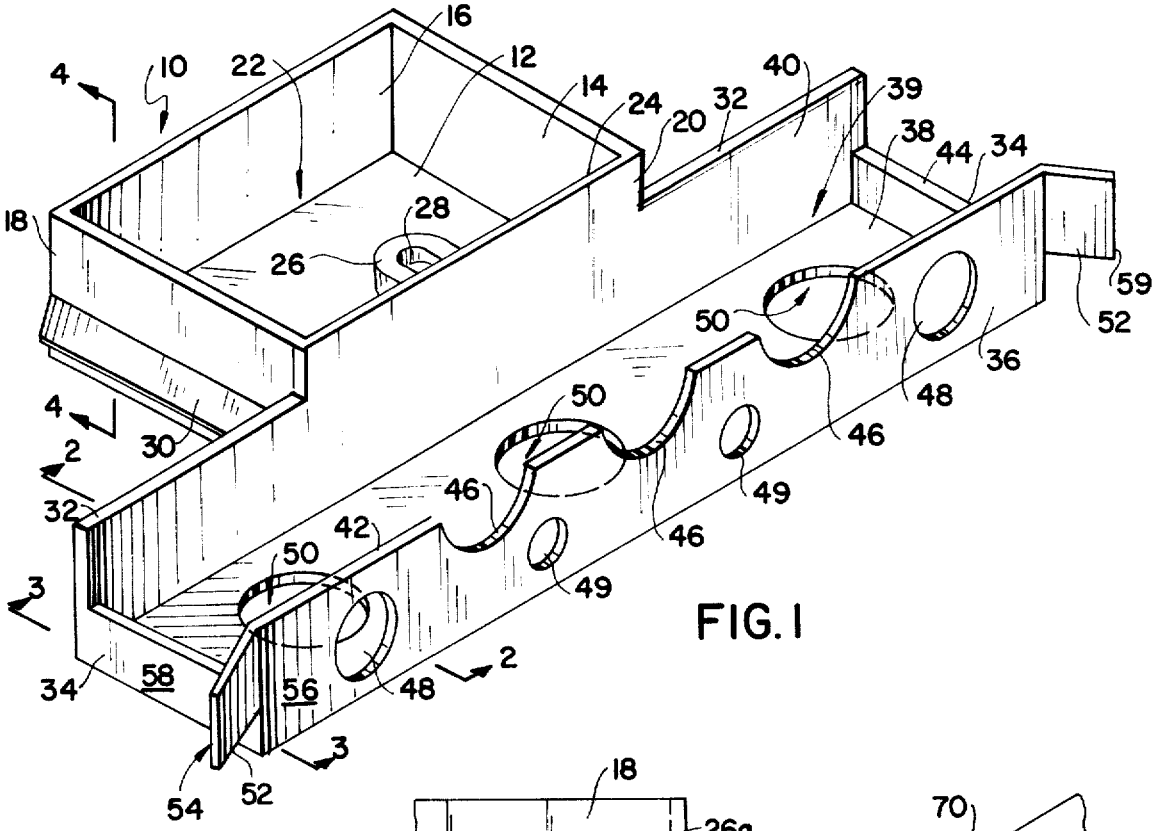
FIG. 1 is a perspective view of the present invention.

The structure and method of fabrication of the present invention is applicable to an ash receiver, preferably fabricated from a metallic material, such as plated steel. The ash receiver is in the form of a compartment having a base and four walls upstanding therefrom. Two opposed walls are provided having an elongated sheet, of V-shaped cross section, extended along the length thereof, such that the open mouth portion of the V-shaped cross section is disposed in a downward fashion opposite the open mouth portion of the ash receiving container. Such sheets serve as support rails for the ash receiving compartment, and other portions of the present invention secured thereto, when supported on conjugately configured supporting surfaces. Such supporting surfaces are generally provided on motor vehicles and are located adjacent an opening in a substantially vertical panel, such as a dashboard.

A wall, disposed adjacent to the opposed walls carrying the V-shaped supporting sheets, extends outwardly of such opposed walls and forms a common wall for an adjacent container-like apparatus. The adjacent container is provided having an opposed wall, disposed opposite to the common wall and spaced apart therefrom, and a pair of end walls intermediate thereto, defining an open mouth portion of the adjacent container. A base joins such end walls and opposed wall and common wall. The base of the adjacent container may be located in a different plane than the base of the ash receiving container, preferably located extending the base of the ash receiving container. The base of the adjacent container is provided having a plurality of holes therein, such holes being disposed in spaced apart relationship and extending in a single row, between opposed ends of the adjacent container. The holes in the base of the adjacent container are particularly useful in having the stems of pipes disposed therethrough such that the bowls of the pipes are caused to reside in the adjacent container. The opposed wall, disposed located outwardly from the exposed surface of the panel of the motor vehicle having the ash receiving open therein, is located within the motor vehicle and may serve as a handle for purposes of withdrawing the ash receiving compartment from a storage position when it is totally contained behind the panel to which it is slideably affixed. Supplemental handles may be provided by affixing to the ends of the opposed wall a pair of tabs. Such tabs have the free end thereof disposed outwardly from the ends of the opposed wall and outwardly from the exterior surface of the opposed wall, so as to have such free ends located intermediate the exterior surface said of the end walls and the exterior surface of the opposed wall. The tabs may be fabricated from a plastic material, such as a phenolic-like compound. The end walls, opposed wall and base of the adjacent compartment may also be fabricated from a phenolic-like compound, or of any other heat-resistant plastic material, or of a suitable metallic material, such as stainless steel.

The uppermost marginal edge of the opposed wall is provided having a plurality of semi-circular notches disposed in spaced apart relationship along the length thereof. Such notches may be utilized to provide support for cigars or cigarettes, having one end thereof disposed resting on the upper surface of the base of the adjacent compartment. The opposed wall is also provided having a first plurality of holes therein for purposes of supporting cigars or cigarettes. Such holes or utilized by having the cylindrical-like smoking implement pass therethrough and have one end thereof rest upon the base of the adjacent compartment. Some of the plurality of holes located in the opposed wall are of small diameter, relative to other larger diameter holes. The smaller holes are particularly useful in providing support for cigarettes, in like manner. Holes located in the opposed wall may be positioned so as to be displaced out of alignment with the hole in the base of the adjacent compartment, thereby facilitating the ends of the cylindrical smoking implements being supported by the base of the adjacent compartment, rather than falling through the holes located in the base of such adjacent compartment.

The shape and size of the adjacent compartment is configured so as to permit packs of cigarettes, matches, cigarette lighters and the like to be stored therewithin, as well as pipes, cigars, cigarettes and the like. The length of the adjacent compartment, defined by the length of the common wall, may be selected so as to accommodate any number of desired smoking implements. The apparatus comprising the present invention may be fitted with cigarette lighters, release mechanisms, well known in the art, for releasing the ash receiving compartment from engagement with the dashboard-like supporting structure and other fitments well known to the art. Decorative indicia, rounded corners, embossed or debossed surfaces, trim and various decorative endeavors may be employed so as to provide a neat and finished device, compatible in appearance with the interior of the vehicle thereby providing eye appeal as well as a functional apparatus.

Now referring to the figures, and more particularly to the apparatus illustrated in FIG. 1 showing the present invention 10 having a base portion 12, side wall 14 and rear wall 16 and side wall 18 and common wall 20. Open mouth portion 22, defined by walls 14, 16, 18 and 20, provides access to a smoking compartment. Uppermost marginal edge 24, of common wall 20 is disposed above snuffing sheet 26, affixed within the ash receiving compartment, and is provided having a small hole 28 therein, for purposes of aiding the extinguishment of cigarettes having their lit end pressed thereinto. Side rail 30, is shown on the exterior surface of wall 18. Another side rail, not shown, is disposed from the exterior surface of wall 14. Rail 30 is of a generally V-shaped cross section, disposed in an inverted position, being utilized to provide vertical support for the apparatus, in sliding relationship, to another knife-like surface, not shown, affixed to a motor vehicle panel, not shown. Thus, walls 14 and 18 serve as end walls for the drawer-like structure defined by walls 14, 16, 18 and 20. Marginal edges 32, of wall 20, are shown disposed residing below the uppermost marginal edge 24, in the mid-region of wall 20. End walls 34, and opposed wall 36, shown opposed to common wall 20 and spaced apart therefrom, are each joined to base 38, thus forming an adjacent container, having an open mouth portion 39. Such adjacent container is bounded by an interior surface 40, of common wall 20, having marginal edges 32 and 24, and marginal edges 44, of end walls 34, and marginal edges 42, of opposed wall 32. It should be noted that marginal edges 44 are disposed somewhat below marginal edges 32 and 24, as well as being below marginal edges 42, relative to the height thereof, above the uppermost lateral surface of base 38. This is so, so as to provide access to cigarette packages, not shown, stored in open mouth portion 39. Uppermost marginal edges 42 are provided having semi-circular notches 46. Holes 48 and smaller holes 49 are located in wall 36. Holes 50 are shown located in base 38. Tabs 52 extend having their outermost ends 54, in wing-like fashion, outwardly from the exterior surface 56, of wall 36, and the exterior surface 58, of walls 34. Holes 49 are disposed out of alignment with holes 50, as are holes 48.

Figure 2:
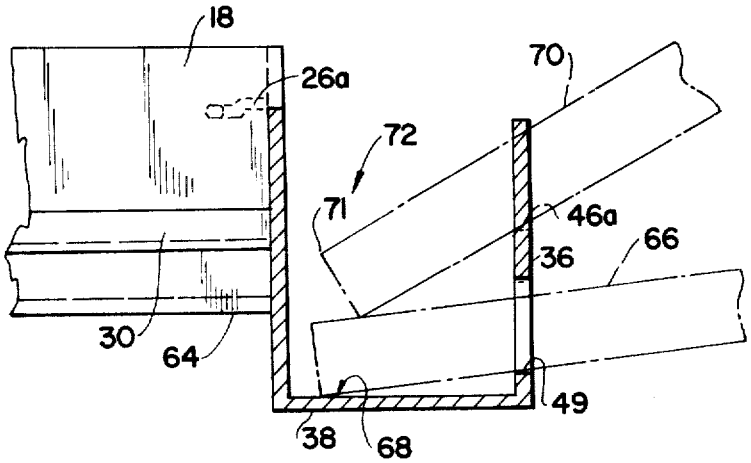
FIG. 2 is a side elevation cross sectional view, taken along lines 2—2, viewed in the direction of arrows 2—2, of the apparatus shown in FIG. 1.

FIG. 2 illustrates dotted lines 66, depicting a cigar or cigarette, having end 68 thereof shown resting on base 38. Dotted lines 66, depict the smoking article passing through hole 49. Dotted lines 70, depict another cylindrical smoking object, such as a cigar, resting on notch 46a, represented by numerals 46, in FIG. 1. End 71, of the smoking article depicted by dotted lines 70, is permitted to move in the direction of arrow 72, out of a horizontal position, into the position shown, so as to provide resting the smoking article in an inclined fashion and thereby supporting same against vibration experienced by the vehicle. Dotted lines 26a depict the cigarette snubbing sheet 26, shown in FIG. 1, and residing above the lowermost lateral surface 64, of base 12, shown in FIG. 1.

Figure 3:
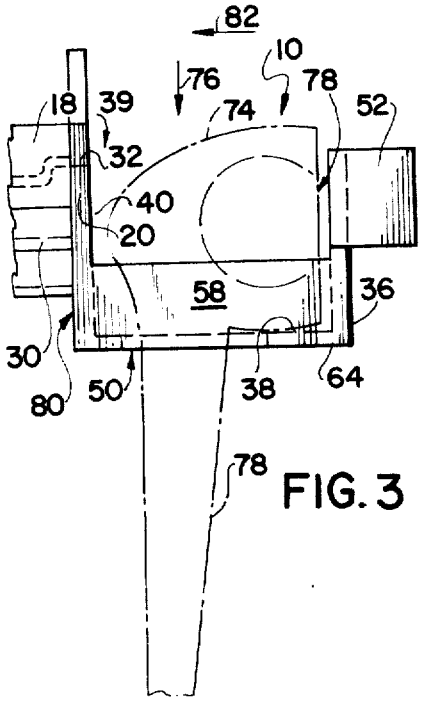
FIG. 3 is a side elevation view, viewed in direction of arrows 3—3, of the apparatus shown in FIG. 1.

FIG. 3 illustrates dotted lines 74 in the form of the silhouette of a pipe. Region 78 thereof represents a pipe stem, shown passing through hole 50 located in lowermost lateral surface 64 of base 38. Exterior surface 58, is shown extending below tab 52. The pipe is inserted into open mouth portion 39 by having region 78 disposed downwardly, in the direction of arrow 76, into hole 50. Mouth portion 78, of the pipe, is shown disposed adjacent to wall 36, shielding any burning embers within the pipe from accidental dislodgment into the interior of the vehicle. Surface 80, bounded by marginal edge 32 of common wall 20 and disposed opposite to interior surface 40 thereof, is generally disposed parallel to a dashboard surface, not shown, when the present invention 10 is moved in the direction of arrow 82. Side wall 18, including element 30, is then hidden from view.

Figure 4:
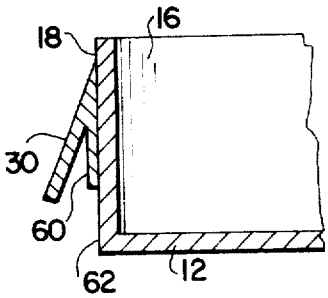
FIG. 4 is a side elevation cross sectional view, taken along lines 4—4, viewed in direction of arrows 4—4, of the apparatus shown in FIG. 1.

FIG. 4 illustrates element 30, having leg 60, secured to exterior surface 62, of side wall 18. Another element 30, not shown, is secured to an exterior surface of side wall 14, shown in FIG. 1, in identical fashion.

One of the advantages of the present invention is an ash tray having storage facilities for smoking implements thereon.

Another advantage of the present invention is an ash receiver which may be slideably affixed to a panel of the motor vehicle.

Still another advantage of the present invention is an ash receiver having smoking implement storage facilities constantly in view of the user thereof.

Yet another advantage of the present invention is a smoking implement holder which is permanently affixed to an ash receiver of a motor vehicle.

A further advantage of the present invention is an ash receiver, having smoking article storage facilities, which may be installed into existing motor vehicle ash receiving holding fixtures.

Another advantage of the present invention is an ash receiving and smoking implement retaining device which serves to coordinate a smoker's need in one central location.

Still another advantage of the present invention is an ash receiver which may support cigarettes, cigars and pipes, as well as receive the waste, in ash form, generated thereby.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

I claim:

1. An ash tray comprising an ash receiving compartment, an adjacent compartment, said ash receiving compartment having a base and a pair of side walls and an end wall and a common wall upstanding therefrom, said pair of side walls and said end wall and said common wall defining an open mouth portion of said ash receiving compartment, means to slideably affix said ash receiving compartment to a panel of a motor vehicle, said adjacent compartment having a pair of end walls and said common wall and an opposed wall upstanding from a base portion affixed thereto, said pair of end walls and said common wall and said opposed wall defining an open mouth portion of said adjacent compartment, said base portion having a plurality of holes therein, said opposed wall having a plurality of holes therein, said opposed wall having a plurality of notches therein, hand grasping means affixed to said adjacent compartment for providing a finger grasping portion thereon, said open mouth portion of said ash receiving compartment being disposed located above said base of said ash receiving compartment, said open mouth portion of said adjacent compartment being disposed above said base portion, at least a portion of the marginal edge of said common wall defining said open mouth portion of said ash receiving compartment and said open mouth portion of said adjacent compartment.

2. The apparatus as claimed in claim 1 further comprising a pair of sheet-like tabs, each of said sheet-like tabs having one end thereof fixedly secured at an exterior surface of said opposed wall, the other end of said each of said pair of sheet-like tabs extending outwardly from said exterior surface of said opposed wall and the exterior surface of an adjacent one of said pair of end walls.

3. The apparatus as claimed in claim 1 wherein a sub-plurality of holes of said plurality of holes in said opposed wall are smaller in diameter than the remaining number of holes in said plurality of holes in said opposed wall.

4. The apparatus as claimed in claim 1 wherein said base portion is disposed having an upper lateral surface thereof extending below a lowermost lateral surface of said base of said ash receiving compartment.

5. The apparatus as claimed in claim 1 wherein the length of said common wall is greater than the length of said rear wall.

6. The apparatus as claimed in claim 1 wherein said pair of end walls are disposed having a lesser height than said common wall and said opposed wall.

7. The apparatus as claimed in claim 1 further comprising means to extinguish a lighted smoking implement disposed secured within said ash receiving compartment.

8. The apparatus as claimed in claim 1 wherein the marginal edge of said common wall is provided having at least two portions thereof extending at different heights over said base portion.

9. The apparatus as claimed in claim 1 wherein said plurality of holes in said opposed wall are configured to receive therein cylindrically shaped smoking implements.

10. The apparatus as claimed in claim 1 wherein said plurality of holes in said base portion are configured to receive therein portions of the stem of a pipe.

11. The apparatus as claimed in claim 1 wherein said open mouth portion of said adjacent compartment is configured to receive therethrough bowl portions of a pipe.

* * * * *